US006561898B2

(12) United States Patent
Moody

(10) Patent No.: US 6,561,898 B2
(45) **Date of Patent: *May 13, 2003**

(54) ELECTRONIC MULTI-HAND STUD POKER GAMES

(76) Inventor: Ernest W. Moody, 2116 Redbird Dr., Las Vegas, NV (US) 89134

( * ) Notice: Subject to any disclaimer, the term of this patent is extended or adjusted under 35 U.S.C. 154(b) by 0 days.

This patent is subject to a terminal disclaimer.

(21) Appl. No.: 09/942,062

(22) Filed: Aug. 29, 2001

(65) Prior Publication Data

US 2002/0043765 A1 Apr. 18, 2002

Related U.S. Application Data

(63) Continuation-in-part of application No. 09/698,892, filed on Oct. 26, 2000, and a continuation-in-part of application No. 09/633,479, filed on Aug. 7, 2000, and a continuation-in-part of application No. 09/175,226, filed on Oct. 20, 1998, now Pat. No. 6,098,985, and a continuation-in-part of application No. 09/083,531, filed on May 22, 1998, now Pat. No. 6,007,066, and a continuation-in-part of application No. 08/900,965, filed on Jul. 25, 1997, now Pat. No. 5,823,873, and a continuation-in-part of application No. 08/755,174, filed on Nov. 25, 1996, now Pat. No. 5,732,950, which is a continuation-in-part of application No. 08/495,952, filed on Jun. 28, 1995, now Pat. No. 5,531,448.

(60) Provisional application No. 60/019,879, filed on Jun. 17, 1996.

(51) Int. Cl.[7] ..... A63F 1/00

(52) U.S. Cl. ..... 463/13; 273/292

(58) Field of Search ..... 273/292, 274, 273/309; 463/12, 13

(56) References Cited

U.S. PATENT DOCUMENTS

| | | | | |
|---|---|---|---|---|
| 5,042,818 A | * | 8/1991 | Weingardt | 273/292 |
| 5,100,137 A | | 3/1992 | Fulton | 273/85 CP |
| 5,167,413 A | | 12/1992 | Fulton | 463/13 |
| 5,265,882 A | | 11/1993 | Malek | 273/292 |
| 5,288,081 A | | 2/1994 | Breeding | 273/292 |
| 5,328,189 A | | 7/1994 | Malek | 273/292 |
| 5,356,140 A | | 10/1994 | Dabrowski et al. | 463/13 |
| 5,377,993 A | | 1/1995 | Josephs | 273/292 |
| 5,417,430 A | | 5/1995 | Breeding | 273/292 |
| 5,486,005 A | | 1/1996 | Neal | 273/292 |
| 5,496,038 A | | 3/1996 | Kangsanaraks | 273/292 |
| 5,544,892 A | | 8/1996 | Breeding | 273/292 |
| 5,573,249 A | | 11/1996 | Johnson | 273/292 |
| 5,577,731 A | | 11/1996 | Jones | 273/292 |
| 5,639,092 A | | 6/1997 | Macaisa | 273/292 |
| 5,664,781 A | | 9/1997 | Feola | 273/292 |
| 5,743,530 A | | 4/1998 | Sklad et al. | 273/274 |
| 5,816,915 A | | 10/1998 | Kadlic | 463/13 |
| 6,007,066 A | * | 12/1999 | Moody | 273/292 |
| 6,050,568 A | | 4/2000 | Hachquet | 273/292 |
| 6,135,883 A | | 10/2000 | Hachquet | 463/13 |

* cited by examiner

*Primary Examiner*—Benjamin H. Layno
(74) *Attorney, Agent, or Firm*—John Edward Roethel

(57) ABSTRACT

A player makes a wager to play multiple hands of a stud poker game which is allocated among the number of hands that the player selects to play. Once the player has made his wager, a plurality of initial partial hands are displayed to the player. Each initial partial hand has the same cards with the cards displayed face up to the player. The player is then provided with the opportunity to increase or decrease his wager on each hand before the hand is completed. Each hand is then completed as a stud poker final hand by dealing the additional cards. The player wins or loses depending on the poker hand ranking of each final hand. The amount won by the player is based on the poker hand ranking of each final hand and the amount wagered by the player according to a pay table.

36 Claims, 4 Drawing Sheets

ELECTRONIC MULTI-HAND STUD POKER GAMES

CROSS-REFERENCE TO RELATED APPLICATIONS

This application is a Continuation-in-Part of application Ser. No. 08/495,952, entitled "Poker-Style Card Game", filed Jun. 28, 1995, now U.S. Pat. No. 5,531,448; and is also based on and is a Continuation-in-Part of Provisional Application Serial No. 60/019,879, entitled "Electronic Video Poker Games", filed Jun. 17, 1996; and is also a Continuation-in-Part of application Ser. No. 08/755,174, entitled "Electronic Video Poker Games", filed Nov. 25, 1996, now U.S. Pat. No. 5,732,950; and is also a Continuation-in-Part of Application Ser. No. 08/900,965, entitled "Electronic Video Poker Games", filed Jul. 25, 1997, now U.S. Pat. No. 5,823,873; and is also a Continuation-in-Part of application Ser. No. 09/083,531, entitled "Electronic Video Poker Games", filed May 22, 1998, now U.S. Pat. No. 6,007,066; and is also a Continuation-in-Part of application Ser. No. 09/175,226, entitled "Electronic Video Poker Games", filed Oct. 20, 1998, now U.S. Pat. No. 6,098,985; and is also a Continuation-in-Part of application Ser. No. 09/633,479, entitled "Electronic Video Slot and Poker Games", filed Aug. 7, 2000, now pending; and is also a Continuation-in-Part of application Ser. No. 09/698,892, entitled "Electronic Video Slot and Poker Games", filed Oct. 26, 2000, now pending. The disclosure of each of these earlier patents and/or applications is incorporated herein by this reference, with each of these earlier applications being commonly owned with this application.

BACKGROUND OF THE INVENTION

This invention relates primarily to electronic video poker games, and more particularly to electronic video stud poker games that are based on poker hand rankings and allow the player to play multiple hands at the same time. The player starts with two or more identical partial hands and then each hand is completed by the displaying of additional cards so that each hand is a final stud poker hand.

The player may increase or decrease his wager on each hand prior to the completion of the final stud poker hands.

Five card, six card and seven card stud have been played for many years, usually in a poker room setting in which a plurality of players play against each other striving to obtain the highest ranking poker hand (or lowest ranking poker hand in Lo-Ball poker) in order to win the pot which comprises the wagers made by the players during the play of the game.

Electronic video poker has also been a staple in gaming casinos for many years and this well known game is a single player game based on draw poker. The player attempts to achieve a winning poker hand ranking by discarding from an initial five card hand and drawing new cards in order to try and improve his poker hand. A pay table is provided to show the player what he can win based on the poker hand ranking achieved after the draw step and the amount wagered by the player.

There have been attempts to adapt stud poker to an electronic video game format. One attempt involved a single player seven card stud game in which the player makes a first wager and initially received three cards face up. In one version of this game, the player has the option of making additional wagers before the player receives the fourth, fifth, sixth and seventh cards. In another version, the player also has the option of making additional wagers before receiving the fourth, fifth, sixth and seventh cards unless the player has already achieved a winning poker hand combination, in which case the player is not allowed to make additional wagers. In either version, the final seven cards are analyzed and the best five card hand is used to determine the poker hand ranking of the player's hand. A pay table is used based on five card poker hand rankings and the amount wagered by the player to determine the amount won by the player when he achieves a winning hand.

Another popular single player stud poker game is known as DOUBLE DOWN STUD® poker. This game is described in U.S. Pat. No. 5,100,137 and U.S. Pat. No. 5,167,413, the disclosures of each of which are incorporated herein by this reference. In DOUBLE DOWN STUD® poker, the player makes a first wager and is dealt four cards all face up. The player may make an additional wager prior to receiving the fifth card. After the fifth card is dealt, the five card hand is compared to a pay table to determine if the player has a winning or losing card combination based on poker hand ranking.

Another stud poker game that has been adapted to a single player video poker format is a game known as LET IT RIDE®. In this game, the player makes a wager of three units at the start of each round of play. The player is then shown three cards face up. The player may decrease his wager by one unit or let all three wagers ride. The player is then shown a fourth card. The player may decrease his wager by one unit or let his wagers ride. The player is then shown a fifth card and the poker hand ranking of the final five card hand is used to determine winning or losing plays based on a pay table. The method of play of LET IT RIDE® is described in U.S. Pat. No. 5,288,081, U.S. Pat. No. 5,417,430 and U.S. Pat. No. 5,544,892, the disclosures of which are incorporated herein.

It is an object of the present invention to provide a multi-hand format to stud poker games.

It is a feature of the present invention to deal and display multiple partial hands to the player, each partial hand having the same cards. The player has the option of increasing or decreasing his wager prior to the additional cards needed to complete each hand being revealed. Each partial hand is then completed into a final stud hand by dealing and displaying additional cards to each hand. The poker hand ranking of each final stud hand is determined and winning final hands are paid based on the poker hand ranking of the final stud hand and the amount wagered by the player.

It is an advantage of the present invention that multiple stud hands may be played by the player thereby increasing the enjoyment of the game as well as increasing the number of hands that can be played in a certain time period thereby creating a higher revenue game for the gaming casino.

Other objects, features and advantages of the present invention will become apparent from a consideration of the following detailed description.

SUMMARY OF THE INVENTION

The method of present invention involves the player making a wager to play multiple hands of a stud poker game. The player selects the number of hands that the player wishes to play. The wager is allocated among the number of hands that are to be played.

Once the player has made his wager, a plurality of initial partial hands are displayed to the player. Each initial partial hand has the same cards with the cards displayed face up to the player. The initial partial hand are randomly dealt from a single deck of playing cards.

The player is then provided with the opportunity to increase his wager on each hand before the hand is completed. After the player makes his decision whether to increase his wager, each hand is then completed as a stud poker final hand by dealing the additional cards from either the original single deck of cards (less the initially dealt cards) or from a plurality of partial depleted decks of playing cards, each depleted deck of playing cards comprising a full deck less the cards dealt as the initial partial hand. The player wins or loses depending on the poker hand ranking of each final hand. The amount won by the player is based on the poker hand ranking of each final hand and the amount wagered by the player according to a pay table.

In the preferred embodiment of the present invention, each initial partial hand has four cards and the final hand has five cards. In other variations of the present invention, each initial partial hand can have one, two or three cards and the final hand has five cards. In yet other variations of the present invention, the final hand can have three, four, six, seven or more cards and the initial partial hand would then have less cards than the final hand.

In another alternative embodiment of the present invention, the player makes multiple wagers on each hand at the beginning of the round of play. After the initial partial hand is dealt, the player is provided with the opportunity to decrease his wager on each hand. Whether or not the player decreases his wager, the cards necessary to complete each final hand are dealt and winning or losing outcomes are determined.

DETAILED DESCRIPTION OF THE PREFERRED EMBODIMENTS

The present invention includes a variety of electronic video stud poker games. Each electronic video stud poker game is designed to be played by having the hands to be played by the player displayed on a video screen.

Figure 1:
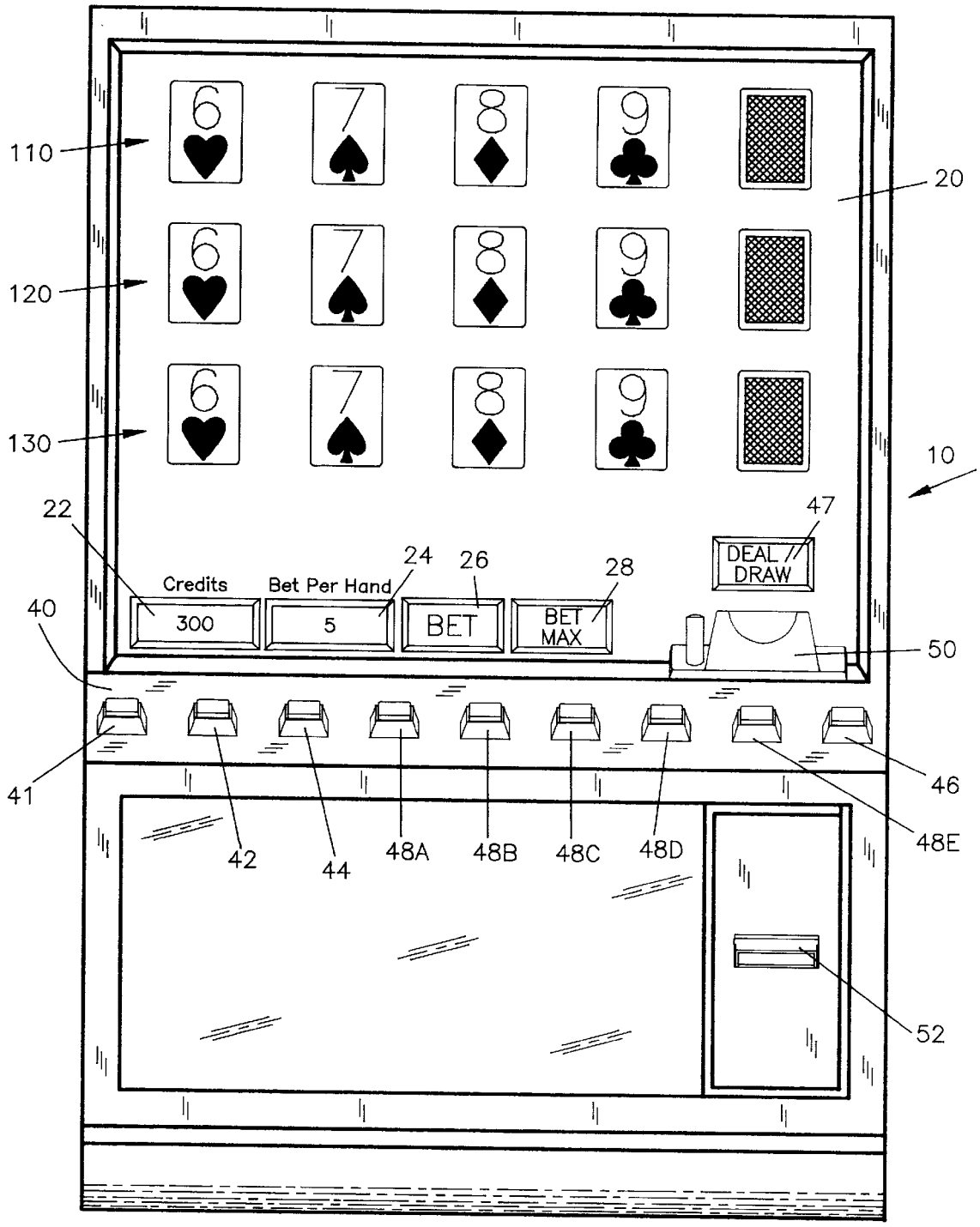
FIG. 1 shows a gaming machine configured to practice the method of present invention with a representative screen display of an initial deal of cards for Version #1A of the game.

FIG. 1 shows a gaming machine upon which the method of the present invention can be carried out. The gaming machine 10 includes a video screen display 20 on which is shown the playing cards that will be used during the play of the method of the present invention. The video screen display 20 also includes other information and data presented to the player to allow the player to understand the play of the game and to effect the operation of the method.

In the preferred embodiment of the present invention, the video screen display 20 shows a credit meter 22 and a display of the "Bet Per Hand" 24 which is the number of credits wagered on each hand for a particular round of play of the game. The video screen display also has a DEAL/DRAW touch screen location to allow the player to cause the initial deal of the cards to be displayed on the video screen display 20. Other touch screen locations allow the player to make his initial wager, which can be made one credit at a time using the BET location 26 or which can be made by wagering the maximum number of credits allowed by the gaming machine using the BET MAX location 28.

The gaming machine 10 also has a button panel 40 which includes typical buttons that the player may press to activate various actions during the play of the method of the present invention. A CASH OUT button 41 is provided to allow the player to collect any credits which the player has accrued on the credit meter 22. A BET MAX button 42 and a BET ONE button 44 are provided to allow the player to wager either the maximum amount of credits or to wager one credit at a time on the play of the game as desired by the player, if the player wishes to use buttons to place his wager instead of using the touch screen locations 26 and 28 to place his wager. A DEAL/DRAW button 46 is provided to allow the player to effect the initial deal step of the method of play as desired should the player prefer to use the button panel instead of the DEAL/DRAW screen location 47 on the video screen display 20.

The gaming machine 10 also includes a coin head 50 to allow the player to insert coins or gaming tokens as wagers to allow play of the gaming machine 10. A bill acceptor slot 52 is also provided on the gaming machine 10. In order to accrue credits that may be used to play the gaming machine 10, the player inserts paper currency or other suitable script or gaming coupons into the bill acceptor slot 52 behind which, on the interior of the gaming machine, is mounted a bill acceptor which takes in and validates the currency. The monetary value of the inserted currency is then applied to the credit meter 22, the credits on which the player may use to play the gaming machine.

A plurality of buttons 48 can also be provided on the button panel 40 to allow the player to select the number of hands which the player wishes to play. For example, TWO HAND button 48A allows the player to select to play two hands. THREE HAND button 48B allows the player to select to play three hands. FIVE HAND button 48C allows the player to select to play five hands. TEN HAND button 48D allows the player to select to play ten hands. FIFTY HAND button 48E allows the player to select to play fifty hands. Any suitable distribution of the number of hands can be allocated to the buttons and fewer or more than five buttons 48 can be used.

Instead of using buttons on the button panel, the video screen display 20 can be provided with touch screen locations (not shown) that the player would touch to select the number of hands that the player wishes to play.

Any other conventional and suitable equipment can be included in the gaming machine.

Version #1A

Version #1A of the present invention uses a standard fifty-two card deck of playing cards. A player makes an initial wager to activate the game and the player selects the number of hands that the player wishes to play during that round of the game. The player also determines the amount of the wager that is to be allocated to each hand of cards that the player will play.

For example, the player may make a wager of fifteen credits and select to play three hands of cards. In the preferred embodiment of the present invention, the computer controls of the gaming machine will allocate five credits to each hand the player has selected to play. Alternatively, the computer controls could prompt the player to input the amount the player wishes to play on each hand.

After the wager is made and after the deck of playing cards has been electronically shuffled, a first partial hand of four cards is randomly dealt and displayed face up to the player on the screen display. These same four cards by suit and rank are also displayed in each of the other partial hands that the player has selected to play, which following the example, would be the second hand and the third hand. Thus, in this example, the player starts with three identical partial hands of four cards all displayed face up.

FIG. 1 shows on the video screen display 20 the first partial hand 110, the second partial hand 120 and the third partial hand 130 with the same four cards shown face up. In the example shown in FIG. 1, the four face up initial cards are the Six of Hearts, the Seven of Spades, the Eight of Diamonds and the Nine of Clubs.

At this point, the player has the option of increasing the amount of his wager on any or all of the hands. In the preferred embodiment of the present invention, the player may double the amount of his wager that has been allocated to each hand. Following the example, the player could wager an additional five credits on each hand.

Alternatively, the player could wager less than an additional five credits on each hand or even more than an additional five credits on each hand if the gaming casino wishes to allow such additional wagering.

For the purposes of the example, the player has wagered an additional five credits on each hand so that the total amount wagered is thirty credits allocated as ten credits on each hand. This additional wagering is optional and the player may continue with the play of each hand even if the player does not make additional wagers.

After the player has completed making additional wagers, if any, the player presses the Draw button 46 or the player presses the Draw screen display location 47 and the computer controls of the gaming machine 10 then proceed to the next step of the method in which the fifth card in each hand is displayed to the player.

In one embodiment of the present invention, the fifth card for each hand is dealt from the depleted deck of forty-eight cards (which represent the cards remaining from the original fifty-two card deck less the four initially dealt cards). Thus in completing each hand, the fifth card is randomly selected from the remaining forty-eight cards. In this embodiment, the depleted forty-eight card deck is reshuffled electronically before the fifth card is dealt to complete each hand.

In another embodiment of the present invention, the fifth card for the first hand 110 is dealt from the depleted deck of forty-eight cards (which represent the cards remaining from the original fifty-two card deck less the four initially dealt cards). The fifth card for the second hand 120 is dealt from the further depleted deck of forty-seven cards (which represent the cards remaining from the original fifty-two card deck less the four initially dealt cards and the fifth card dealt to the first hand 110). The fifth card for the third hand 130 is dealt from the further depleted deck of forty-six cards (which represent the cards remaining from the original fifty-two card deck less the four initially dealt cards, the fifth card dealt to the first hand 110 and the fifth card dealt to the second hand 120). In this embodiment, the cards of each of the depleted decks may or may not be electronically reshuffled before displaying the fifth card to complete each hand.

Figure 2:
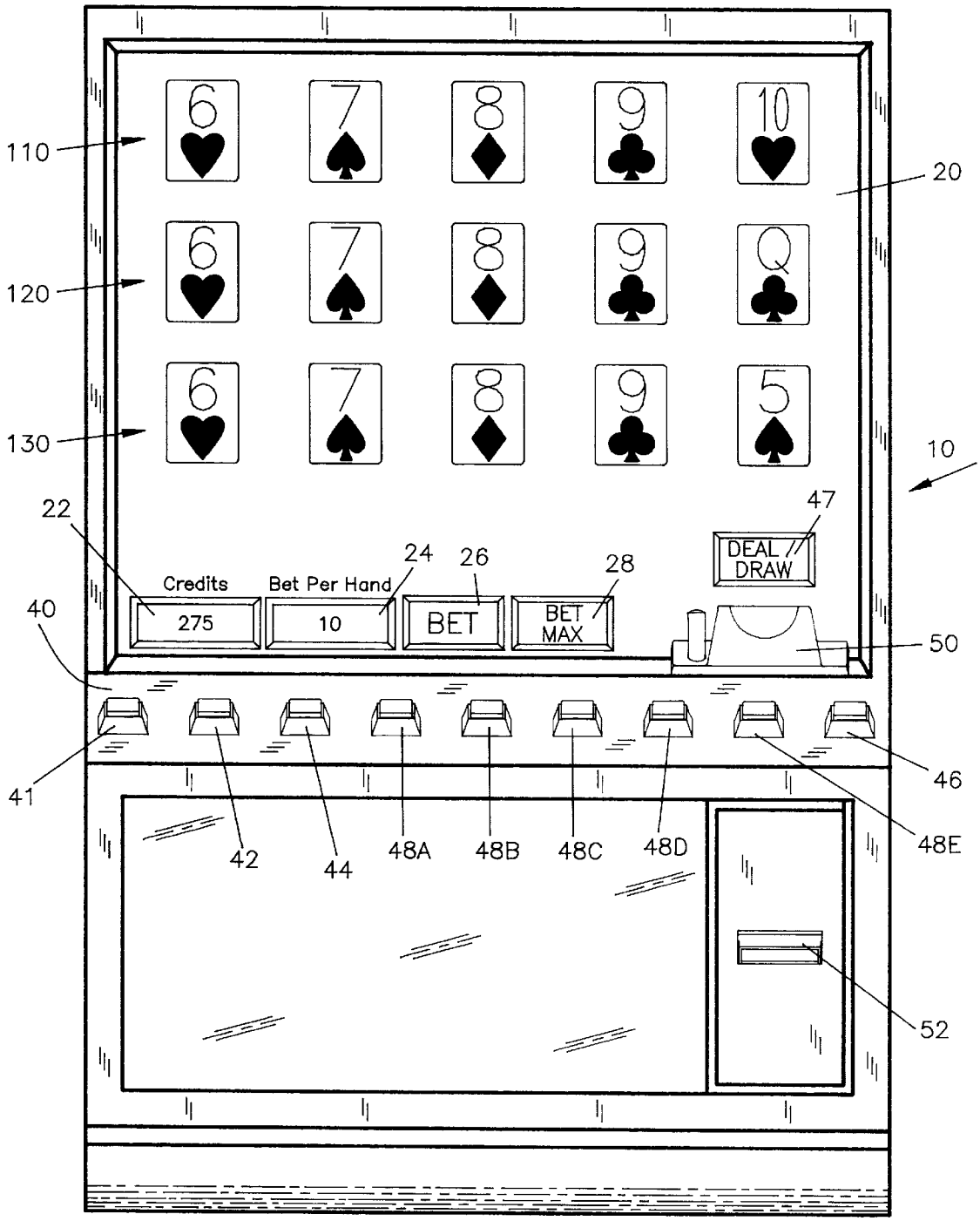
FIG. 2 shows a representative result that could occur during the play of Version #1A of the game.

FIG. 2 shows an example of how the hands may be completed by the display of the fifth card. Hand 110 could result in the Six of Hearts, the Seven of Spades, the Eight of Diamonds, the Nine of Clubs and the Ten of Hearts. Thus, the poker hand ranking of Hand 110 is a Straight and would be a winning hand combination in the preferred embodiment of the present invention.

Hand 120 could result in the Six of Hearts, the Seven of Spades, the Eight of Diamonds, the Nine of Clubs and the Queen of Clubs. The poker hand ranking of this hand is a Queen High which would not be a winning hand combination in the preferred embodiment of the present invention.

Hand 130 could result in the Six of Hearts, the Seven of Spades, the Eight of Diamonds, the Nine of Clubs and the Five of Spades. The poker hand ranking of this hand is also a Straight which would be a winning hand combination in the preferred embodiment of the present invention.

Any suitable poker hand combinations can be designated was winning and losing hand combinations. The amount won by the player is determined according to a pay table based on the poker hand combination achieved by the player and the amount wagered by the player on the hand.

Typically, pay tables are determined based on the mathematical probability of certain poker combinations occurring during the play of the game and based on the desired theoretical hold percentage to be kept by the gaming establishment. Any suitable pay table may be used and a representative pay table is shown in Table 1.

TABLE 1

| Poker Hand Combination | Payout Odds |
|---|---|
| Less than Pair of 6's | Losing Hand |
| Pair of 6's thru 10's | 1 for 1 |
| Pair of Jacks thru Aces | 1 to 1 |
| Two Pair | 2 to 1 |
| Three of a Kind | 3 to 1 |
| Straight | 10 to 1 |
| Flush | 20 to 1 |
| Full House | 30 to 1 |
| Four of a Kind | 100 to 1 |
| Straight Flush | 800 to 1 |
| Royal Flush | 5000 to 1 |

Version #1B

Version #1B of the present invention is similar to Version #1A except that the initially dealt hand has only three cards face up. This allows the player the option twice to increase his wager on each hand.

For example, at the beginning of the round of play, the player elects to play three hands. The player wagers five credits on each hand. The three hands are dealt with each hand having the same three cards face up. The player can now increase his wager on each hand if the player wishes to do so. Regardless of whether the player increases his wager or not, a fourth card is dealt to each hand.

As described above, the fourth card for each hand is dealt from the depleted deck of forty-nine cards (which represent the cards remaining from the original fifty-two card deck less the three initially dealt cards). Thus in completing each hand, the fourth card is randomly selected from the remaining forty-nine cards. In this embodiment, the depleted forty-nine card deck is reshuffled electronically before the fourth card is dealt to complete each hand.

Alternatively, the fourth card for the first hand is dealt from the depleted deck of forty-nine cards (which represent the cards remaining from the original fifty-two card deck less the three initially dealt cards). The fourth card for the second hand is dealt from the further depleted deck of forty-eight cards (which represent the cards remaining from the original fifty-two card deck less the three initially dealt cards and the fourth card dealt to the first hand). The fourth card for the third hand is dealt from the further depleted deck of forty-seven cards (which represent the cards remaining from the original fifty-two card deck less the three initially dealt cards, the fourth card dealt to the first hand and the fourth card dealt to the second hand. In this embodiment, the cards of each of the depleted decks may or may not be electronically reshuffled before displaying the fifth card to complete each hand.

After the fourth card is dealt to each hand, the player is again given the option of increasing his wager on each hand before seeing the fifth card if the player wishes to do so. In the preferred embodiment of the present invention, the player is provided with this option on each hand whether or not the player had increased his wager on that hand before seeing the fourth card. Regardless of whether the player increases his wager or not, a fifth card is then dealt to each hand.

As described above, the fifth card for each hand is dealt from the depleted deck of forty-eight cards (which represent the cards remaining from the original fifty-two card deck less the three initially dealt cards and the fourth card). Thus in completing each hand, the fifth card is randomly selected from the remaining forty-eight cards. In this embodiment, the depleted forty-eight card deck is reshuffled electronically before the fifth card is dealt to complete each hand.

Alternatively, the fifth card for the first hand is dealt from the depleted deck of forty-six cards (which represent the cards remaining from the original fifty-two card deck less the three initially dealt cards and the three additional fourth cards). The fifth card for the second hand is dealt from the further depleted deck of forty-five cards (which represent the cards remaining from the original fifty-two card deck less the three initially dealt cards, the three additional fourth cards and the fifth card dealt to the first hand). The fifth card for the third hand is dealt from the further depleted deck of forty-four cards (which represent the cards remaining from the original fifty-two card deck less the three initially dealt cards, the three additional fourth cards, the fifth card dealt to the first hand and the fifth card dealt to the second hand.) In this embodiment, the cards of each of the depleted decks may or may not be electronically reshuffled before displaying the fifth card to complete each hand.

After all three hands have five cards, winning and losing outcomes are determined based on the winning hand combinations shown in the pay table. Winning hands are paid based on the poker hand ranking achieved and the amount wagered by the player on the winning hand.

Any suitable poker hand combinations may be designated as winning or losing hand combinations and any suitable pay table may be used. Both Version #1A and Version #1B allow the player to increase the amount of wager relative to any particular hand during the play of the game and thus add an extra level of excitement to the game as well as increasing the possibility of the player winning a large payout.

Version #2A

Version #2A of the present invention uses a standard fifty-two card deck of playing cards. A player makes an initial wager to activate the game and the player selects the number of hands that the player wishes to play during that round of the game. The player also determines the amount of the wager that is to be allocated to each hand of cards that the player will play. However, in this version, the player will be provided with the option of decreasing the amount of his wager on each before seeing the additional cards needed to complete the final hand.

For example, the player may make a wager of thirty credits and select to play three hands of cards. In the preferred embodiment of the present invention, the computer controls of the gaming machine will allocate ten credits to each hand the player has selected to play. Alternatively, the computer controls could prompt the player to input the amount the player wishes to play on each hand.

After the wager is made and after the deck of playing cards has been electronically shuffled, a first partial hand of four cards is randomly dealt and displayed face up to the player on the screen display. These same four cards by suit and rank are also displayed in each of the other partial hands that the player has selected to play, which following the example, would be the second hand and the third hand. Thus, in this example, the player starts with three identical partial hands of four cards all displayed face up.

Figure 3:
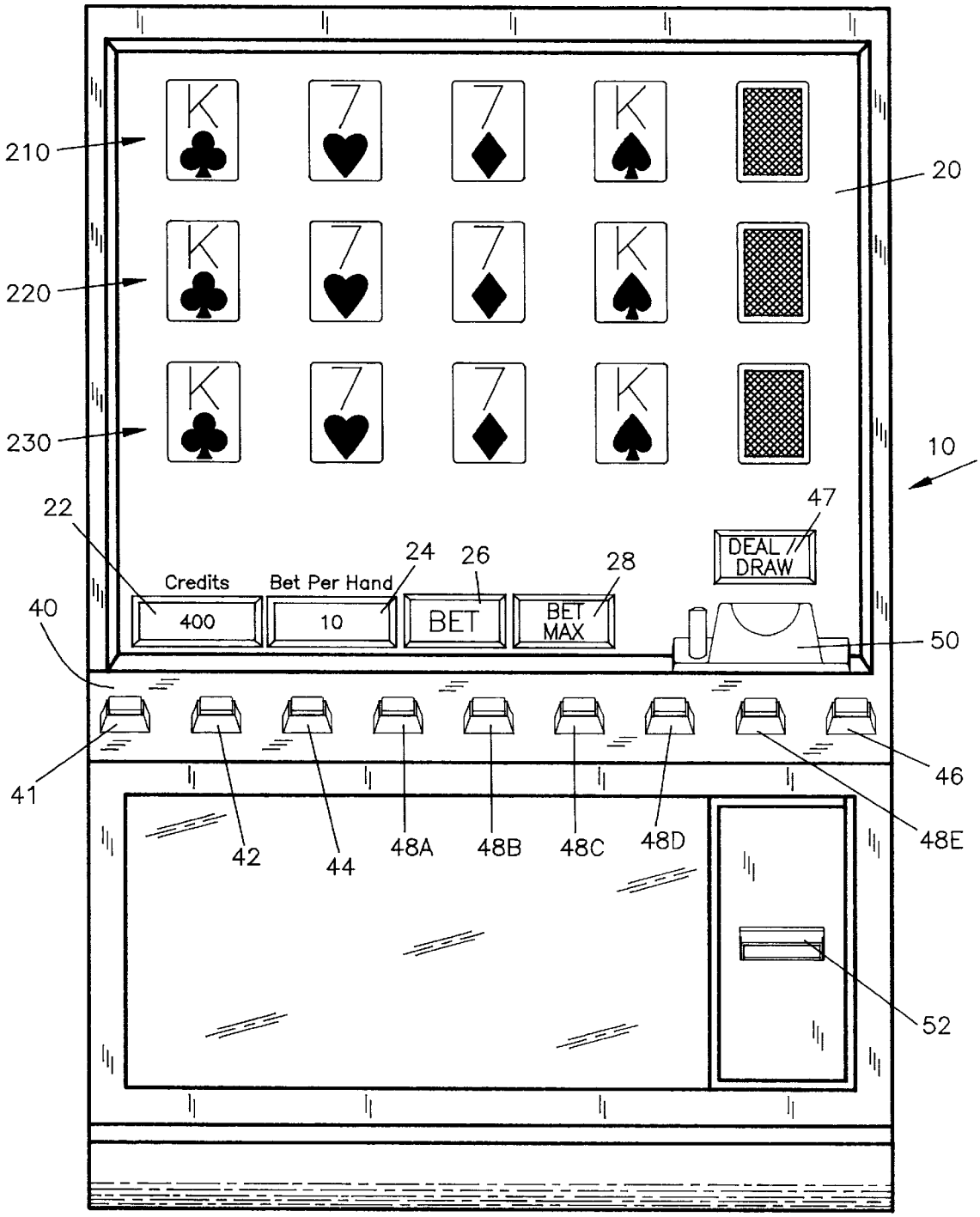
FIG. 3 shows the screen display for Version #2A of the present invention with a representative display of an initial deal of the cards.

FIG. 3 shows on the video screen display 20 the first partial hand 210, the second partial hand 220 and the third partial hand 230 with the same four cards shown face up. In the example shown in FIG. 3, the four face up initial cards are the King of Clubs, the Seven of Hearts, the Seven of Diamonds and the King of Spades.

At this point, the player has the option of decreasing the amount of his wager on any or all of the hands. In the preferred embodiment of the present invention, the player may decrease his wager by half of the amount of his wager that has been allocated to each hand. Following the example, the player could decrease his wager by five credits on each hand.

Alternatively, the player could decrease his wager less than five credits on each hand or even more than five credits on each hand if the gaming casino wishes to allow such additional wagering, but preferably the player would not be allowed to decrease his wager down to zero.

For the purposes of the example, the player has maintained his wager at ten credits on each hand since the player has been dealt a good hand of Two Pair. This option to decrease the wagering is optional and the player may continue with the play of each hand regardless of whether the player elects to decrease his wager.

After the player has completed decreasing his wagers, if the player chooses to do so, the player presses the Draw button 46 or the player presses the Draw screen display location 47 and the computer controls of the gaming machine 10 then proceed to the next step of the method in which the fifth card in each hand is displayed to the player.

In one embodiment of the present invention, the fifth card for each hand is dealt from the depleted deck of forty-eight cards (which represent the cards remaining from the original fifty-two card deck less the four initially dealt cards). Thus in completing each hand, the fifth card is randomly selected from the remaining forty-eight cards. In this embodiment, the depleted forty-eight card deck is reshuffled electronically before the fifth card is dealt to complete each hand.

In another embodiment of the present invention, the fifth card for the first hand 210 is dealt from the depleted deck of forty-eight cards (which represent the cards remaining from the original fifty-two card deck less the four initially dealt cards). The fifth card for the second hand 220 is dealt from the further depleted deck of forty-seven cards (which represent the cards remaining from the original fifty-two card deck less the four initially dealt cards and the fifth card dealt to the first hand 210). The fifth card for the third hand 230 is dealt from the further depleted deck of forty-six cards (which represent the cards remaining from the original fifty-two card deck less the four initially dealt cards, the fifth card dealt to the first hand 210 and the fifth card dealt to the second hand 220). In this embodiment, the cards of each of the depleted decks may or may not be electronically reshuffled before displaying the fifth card to complete each hand.

Figure 4:
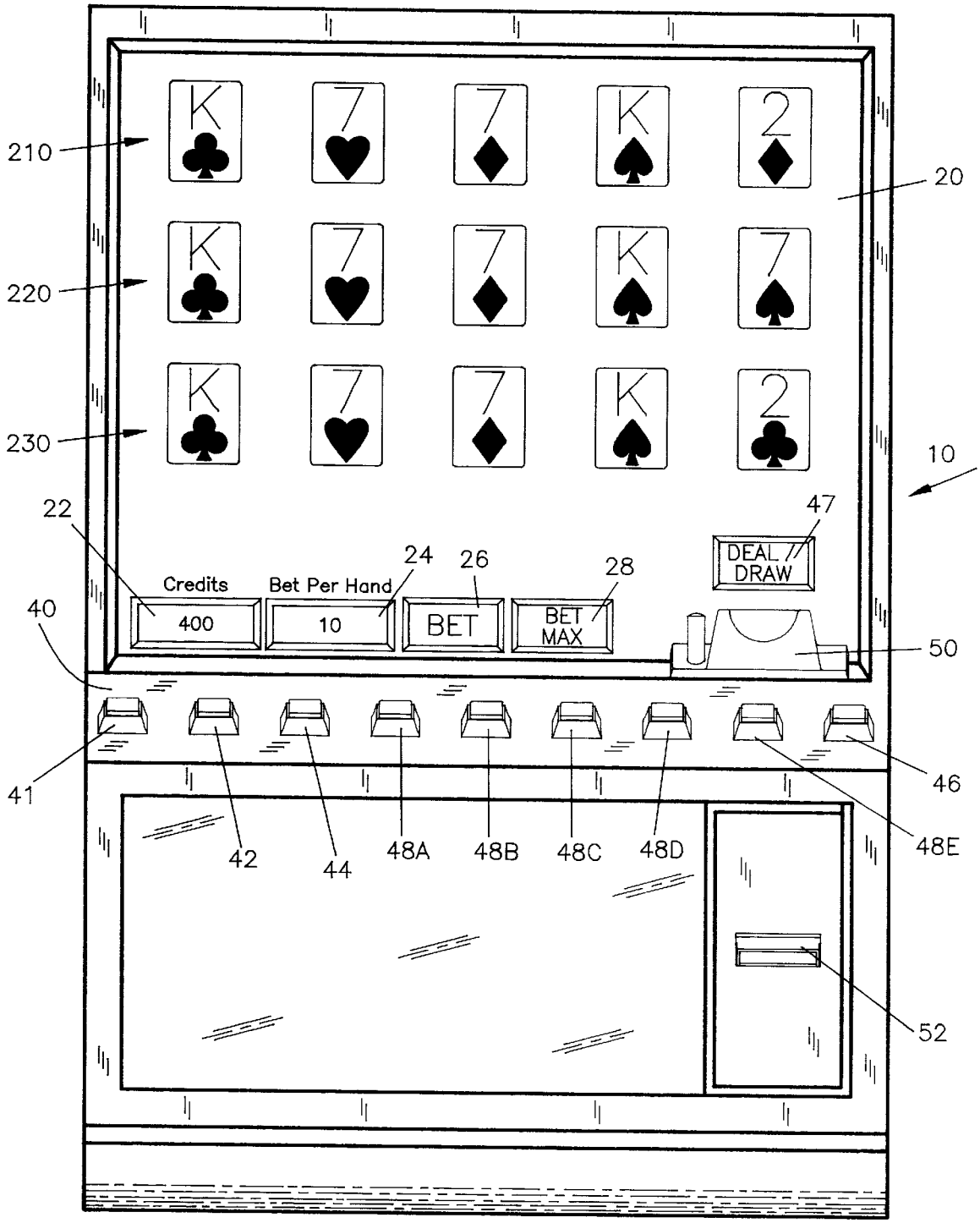
FIG. 4 shows a representative result that could occur during the play of Version #2A of the game.

FIG. 4 shows an example of how the hands may be completed by the display of the fifth card. Hand 210 could result in the King of Clubs, the Seven of Hearts, the Seven of Diamonds, the King of Spades and the Two of Diamonds. Thus, the poker hand ranking of Hand 210 is a Two Pair and would be a winning hand combination in the preferred embodiment of the present invention.

Hand 220 could result in the King of Clubs, the Seven of Hearts, the Seven of Diamonds, the King of Spades and the Seven of Spades. The poker hand ranking of this hand is a Full House which would also be a winning hand combination in the preferred embodiment of the present invention.

Hand 230 could result in the King of Clubs, the Seven of Hearts, the Seven of Diamonds, the King of Spades and the Two of Clubs. The poker hand ranking of this hand is also a Two Pair which would be a winning hand combination in the preferred embodiment of the present invention.

Any suitable poker hand combinations can be designated was winning and losing hand combinations. The amount won by the player is determined according to a pay table based on the poker hand combination achieved by the player and the amount wagered by the player on the hand.

Typically, pay tables are determined based on the mathematical probability of certain poker combinations occurring during the play of the game and based on the desired theoretical hold percentage to be kept by the gaming establishment. Any suitable pay table may be used and a representative pay table is shown in Table 2.

TABLE 2

| Poker Hand Combination | Payout Odds |
|---|---|
| Less than Pair of 6's | Losing Hand |
| Pair of 6's thru 10's | 1 for 1 |
| Pair of Jacks thru Aces | 1 to 1 |
| Two Pair | 2 to 1 |
| Three of a Kind | 3 to 1 |
| Straight | 10 to 1 |
| Flush | 20 to 1 |
| Full House | 30 to 1 |
| Four of a Kind | 100 to 1 |
| Straight Flush | 800 to 1 |
| Royal Flush | 5000 to 1 |

Version #2B

Version #2B of the present invention is similar to Version #2A except that the initially dealt hand has only three cards face up. This allows the player the option twice to decrease his wager on each hand.

For example, at the beginning of the round of play, the player elects to play three hands. The player wagers forty-five credits which are allocated as fifteen credits on each hand. The three hands are dealt with each hand having the same three cards face up. The player can now decrease his wager on each hand if the player wishes to do so. In the preferred embodiment of the this version of the present invention, the player would be allowed to decrease his wager by five credits prior to seeing the fourth card. Alternatively, the player could be allowed to decrease the amount of his wager by more or less than five credits, but preferably the player is not allowed to decrease his wager to zero.

Regardless of whether the player decreases his wager or not, a fourth card is dealt to each hand. As described above, the fourth card for each hand is dealt from the depleted deck of forty-nine cards (which represent the cards remaining from the original fifty-two card deck less the three initially dealt cards). Thus in completing each hand, the fourth card is randomly selected from the remaining forty-nine cards. In this embodiment, the depleted forty-nine card deck is reshuffled electronically before the fourth card is dealt to complete each hand.

Alternatively, the fourth card for the first hand is dealt from the depleted deck of forty-nine cards (which represent the cards remaining from the original fifty-two card deck less the three initially dealt cards). The fourth card for the second hand is dealt from the further depleted deck of forty-eight cards (which represent the cards remaining from the original fifty-two card deck less the three initially dealt cards and the fourth card dealt to the first hand). The fourth card for the third hand is dealt from the further depleted deck of forty-seven cards (which represent the cards remaining from the original fifty-two card deck less the three initially dealt cards, the fourth card dealt to the first hand and the fourth card dealt to the second hand. In this embodiment, the cards of each of the depleted decks may or may not be electronically reshuffled before displaying the fifth card to complete each hand.

After the fourth card is dealt to each hand, the player is again given the option of decreasing his wager on each hand before seeing the fifth card if the player wishes to do so. In the preferred embodiment of the present invention, the player is provided with this option on each hand whether or not the player had increased his wager on that hand before seeing the fourth card. Also, in the preferred embodiment of this version, the player is allowed to decrease his wager by five credits prior to seeing the fifth card. Alternatively, the player could be allowed to decrease the amount of his wager by more or less than five credits, but preferably the player is not allowed to decrease his wager to zero.

Regardless of whether the player increases his wager or not, a fifth card is then dealt to each hand. As described above, the fifth card for each hand is dealt from the depleted deck of forty-eight cards (which represent the cards remaining from the original fifty-two card deck less the three initially dealt cards and the fourth card). Thus in completing each hand, the fifth card is randomly selected from the remaining forty-eight cards. In this embodiment, the depleted forty-eight card deck is reshuffled electronically before the fifth card is dealt to complete each hand.

Alternatively, the fifth card for the first hand is dealt from the depleted deck of forty-six cards (which represent the cards remaining from the original fifty-two card deck less the three initially dealt cards and the three additional fourth cards). The fifth card for the second hand is dealt from the further depleted deck of forty-five cards (which represent the cards remaining from the original fifty-two card deck less the three initially dealt cards, the three additional fourth cards and the fifth card dealt to the first hand). The fifth card for the third hand is dealt from the further depleted deck of forty-four cards (which represent the cards remaining from the original fifty-two card deck less the three initially dealt cards, the three additional fourth cards, the fifth card dealt to the first hand and the fifth card dealt to the second hand. In this embodiment, the cards of each of the depleted decks may or may not be electronically reshuffled before displaying the fifth card to complete each hand.

After all three hands have five cards, winning and losing outcomes are determined based on the winning hand combinations shown in the pay table. Winning hands are paid based on the poker hand ranking achieved and the amount wagered by the player on the winning hand.

Any suitable poker hand combinations may be designated as winning or losing hand combinations and any suitable pay table may be used. Both Version #2A and Version #2B allow the player to decrease the amount of wager relative to any particular hand during the play of the game and thus add an extra level of excitement to the game as well as providing the player the opportunity to minimize his losses if the player is dealt a poor hand initially.

Other variations of either version of the present invention can use only one card or two cards initially dealt face up with the remaining cards of the five card being dealt face down or simply displayed to the player as the game progresses. As described above, the player may increase or decrease his wager prior to seeing each additional card needed to complete each final hand.

Another variation can use hands having more than five cards—such as six, seven or more cards. Less than the entire hand is shown face up with the remaining cards shown face down or displayed to the player as the game progresses. Winning hand combinations can be based on the best five card poker hand achieved out of the six, seven or more card hands. Alternatively, the winning hand combinations can be the best Six, seven or more card poker hand achieved. When six or more card poker hands are used, then additional non-traditional poker hand rankings can be used as winning card combinations such as two Three-of-a-Kinds, or a Four-of-a-Kind and a Pair, Six (or more) Card Straight Flushes and Six (or more) Card Royal Flushes. Again, as described above, the player may increase or decrease his wager prior to seeing each additional card needed to complete each final hand.

It is also possible to use four card, three card or even two card poker hands. Again, less than the entire hand is shown face up with the remaining cards face down and the player is provided with the option of increasing or decreasing his wager prior to seeing the next card.

Another variation would include designating certain cards as wild cards or adding one or more Jokers to the standard deck and using the Jokers as wild cards.

In all of the versions of the present invention, special bonus payouts can be added if each hand completes to the same ending result, such as all of the hands finishing in the same Royal Flush. These bonus payout amounts could be fixed amounts or progressive payout amounts.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a stud poker card game in which a final hand has at least five cards comprising:

a) the player selecting to play at least two hands;

b) a player making a wager which is allocated among the hands selected to be played by the player;

c) dealing and displaying face up a number of partial hands of less than five cards, the number of partial hands corresponding to the number of hands selected to be played by the player, each partial hand having the same cards;

d) after the partial hands are displayed, allowing the player the option to increase his wager on any of the partial hands prior to an additional card being dealt to the partial hand;

e) dealing and displaying face up additional cards to each hand to complete each hand so that each final hand has at least five cards;

f) determining the poker hand ranking of each final hand; and g) paying the player a pre-established amount based on the amount of the wager on each hand if the final hand comprises a predetermined poker hand ranking.

2. The method of claim 1 in which each partial hand has four cards.

3. The method of claim 1 in which each partial hand has three cards.

4. The method of claim 1 in which each partial hand has two cards.

5. The method of claim 1 in which each partial hand has one card.

6. The method of claim 1 in which the additional cards for each final hand are dealt from a depleted deck which consists of the original deck of cards less the cards dealt as the partial hand.

7. The method of claim 1 in which all of the additional cards for each final hand are dealt from the same original deck of cards less the cards dealt as the partial hand.

8. The method of claim 1 in which the final hand has at least six cards and the predetermined poker hand rankings are based on the best five card poker ranking of the final hand.

9. The method of claim 1 in which the final hand has at least six cards and the predetermined poker hand rankings are based on the best six card poker ranking of the final hand.

10. The method of claim 1 in which the final hand has at least seven cards and the predetermined poker hand rankings are based on the best five card poker ranking of the final hand.

11. The method of claim 1 in which the final hand has at least seven cards and the predetermined poker hand rankings are based on the best six card poker ranking of the final hand.

12. The method of claim 1 in which the final hand has at least seven cards and the predetermined poker hand rankings are based on the best seven card poker ranking of the final hand.

13. A method of playing a stud poker card game in which a final hand has a predetermined number of cards comprising:

a) the player selecting to play at least two hands;

b) a player making a wager which is allocated among the hands selected to be played by the player;

c) dealing and displaying face up a number of partial hands of less than the predetermined number of cards, the number of partial hands corresponding to the number of hands selected to be played by the player, each partial hand having the same cards;

d) after the partial hands are displayed, allowing the player the option to increase his wager on any of the partial hands prior to an additional card being dealt to the partial hand;

e) dealing and displaying face up additional cards to each hand to complete each hand so that each final hand has the predetermined number of cards;

f) determining the poker hand ranking of each final hand; and g) paying the player a pre-established amount based on the amount of the wager on each hand if the final hand comprises a predetermined poker hand ranking.

14. The method of claim 13 in which the predetermined number of cards in the final hand is two.

15. The method of claim 13 in which the predetermined number of cards in the final hand is three.

16. The method of claim 13 in which the predetermined number of cards in the final hand is four.

17. The method of claim 13 in which the additional cards for each final hand are dealt from a depleted deck which consists of the original deck of cards less the cards dealt as the partial hand.

18. The method of claim 13 in which all of the additional cards for each final hand are dealt from the same original deck of cards less the cards dealt as the partial hand.

19. A method of playing a stud poker card game in which a final hand has at least five cards comprising:

a) the player selecting to play at least two hands;

b) a player making a wager which is allocated among the hands selected to be played by the player;

c) dealing and displaying face up a number of partial hands of less than five cards, the number of partial hands corresponding to the number of hands selected to be played by the player, each partial hand having the same cards;

d) after the partial hands are displayed, allowing the player the option to decrease his wager on any of the partial hands prior to an additional card being dealt to the partial hand;

e) dealing and displaying face up additional cards to each hand to complete each hand so that each final hand has at least five cards;

f) determining the poker hand ranking of each final hand; and g) paying the player a pre-established amount based on the amount of the wager on each hand if the final hand comprises a predetermined poker hand ranking.

20. The method of claim 19 in which each partial hand has four cards.

21. The method of claim 19 in which each partial hand has three cards.

22. The method of claim 19 in which each partial hand has two cards.

23. The method of claim 19 in which each partial hand has one card.

24. The method of claim 19 in which the additional cards for each final hand are dealt from a depleted deck which consists of the original deck of cards less the cards dealt as the partial hand.

25. The method of claim 19 in which all of the additional cards for each final hand are dealt from the same original deck of cards less the cards dealt as the partial hand.

26. The method of claim 19 in which the final hand has at least six cards and the predetermined poker hand rankings are based on the best five card poker ranking of the final hand.

27. The method of claim 19 in which the final hand has at least six cards and the predetermined poker hand rankings are based on the best six card poker ranking of the final hand.

28. The method of claim 19 in which the final hand has at least seven cards and the predetermined poker hand rankings are based on the best five card poker ranking of the final hand.

29. The method of claim 19 in which the final hand has at least seven cards and the predetermined poker hand rankings are based on the best six card poker ranking of the final hand.

30. The method of claim 19 in which the final hand has at least seven cards and the predetermined poker hand rankings are based on the best seven card poker ranking of the final hand.

31. A method of playing a stud poker card game in which a final hand has a predetermined number of cards comprising:

a) the player selecting to play at least two hands;

b) a player making a wager which is allocated among the hands selected to be played by the player;

c) dealing and displaying face up a number of partial hands of less than the predetermined number of cards, the number of partial hands corresponding to the number of hands selected to be played by the player, each partial hand having the same cards;

d) after the partial hands are displayed, allowing the player the option to decrease his wager on any of the partial hands prior to an additional card being dealt to the partial hand;

e) dealing and displaying face up additional cards to each hand to complete each hand so that each final hand has the predetermined number of cards;

f) determining the poker hand ranking of each final hand; and g) paying the player a pre-established amount based on the amount of the wager on each hand if the final hand comprises a predetermined poker hand ranking.

32. The method of claim 31 in which the predetermined number of cards in the final hand is two.

33. The method of claim 31 in which the predetermined number of cards in the final hand is three.

34. The method of claim 31 in which the predetermined number of cards in the final hand is four.

35. The method of claim 31 in which the additional cards for each final hand are dealt from a depleted deck which consists of the original deck of cards less the cards dealt as the partial hand.

36. The method of claim 31 in which all of the additional cards for each final hand are dealt from the same original deck of cards less the cards dealt as the partial hand.

* * * * *